US006475306B1

(12) United States Patent
Kanisawa et al.

(10) Patent No.: US 6,475,306 B1
(45) Date of Patent: Nov. 5, 2002

(54) HOT ROLLED STEEL WIRE ROD OR BAR FOR MACHINE STRUCTURAL USE AND METHOD FOR PRODUCING THE SAME

(75) Inventors: Hideo Kanisawa; Tatsuro Ochi; Manabu Kubota; Koji Tanabe; Kiichiro Tsuchida, all of Muroran (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/829,741

(22) Filed: Apr. 10, 2001

(51) Int. Cl.[7] ..... C22C 38/04; C22C 38/02; C21D 8/06

(52) U.S. Cl. ..... 148/320; 148/598

(58) Field of Search ..... 148/598, 320

(56) References Cited

U.S. PATENT DOCUMENTS 4,370,178 A * 1/1983 Waid et al. ..... 148/320
4,466,842 A * 8/1984 Yada et al. ..... 148/320
5,470,529 A * 11/1995 Nomura et al. ..... 148/320

* cited by examiner

*Primary Examiner*—Deborah Yee
(74) *Attorney, Agent, or Firm*—Kenyon & Kenyon

(57) ABSTRACT

The present invention provides a hot rolled steel wire rod or bar for machine structural use having, even when a spheroidizing annealing time is reduced, cold workability equal to that of the wire rods or bars treated through conventional spheroidizing annealing of a long treatment time, as a result of controlling a metallographic structure, and a method to produce the same: and relates to a hot rolled steel wire rod or bar for machine structural use, characterized in that; the wire rod or bar is made from a steel consisting of, in weight, 0.1 to 0.5% of C, 0.01 to 0.5% of Si, 0.3 to 1.5% of Mn, and the balance comprising Fe and unavoidable impurities and containing hardening elements as required; its microstructure consists of ferrite and pearlite; its ferrite crystal grain size number defined under Japanese Industrial Standard (JIS) G 0552 is 11 or higher; the granular carbide 2 $\mu$m or less in circle-equivalent diameter and having an aspect ratio of 3 or less accounts for a percentage area of 3 to 15%; and its hardness (Hv) satisfies the expression below, $$165\ Ceq+73.5 \leqq Hv \leqq 195\ Ceq+73.5$$

(where, Ceq=C%+1/7 Si%+1/5 Mn%+1/9 Cr%).

5 Claims, 3 Drawing Sheets

(×1000)

(×1000)

(×1000)

(×1000)

(×1000)

HOT ROLLED STEEL WIRE ROD OR BAR FOR MACHINE STRUCTURAL USE AND METHOD FOR PRODUCING THE SAME

BACKGROUND OF THE INVENTION

1. Field of the Invention

This invention relates to a hot rolled steel wire rod or bar for machine structural use and a method to produce the same and, more specifically, to a steel wire rod or bar for machine structural use for manufacturing components for cars and construction machines and the like, enabling cold working such as drawing, machining, cold forging and the like by applying a short time spheroidizing annealing, and a method to produce the same.

2. Description of the Related Art

Machine structural components such as those of cars and construction machines and the like, for example, bolts, stabilizers, etc., have been manufactured conventionally by softening a hot rolled steel wire rod or bar of carbon steel for machine structural use or alloy steel to secure cold workability, then forming it by cold working such as cold forging, drawing, machining and the like, then quenching and tempering the pieces thus formed.

When manufacturing bolts from a hot rolled steel wire rod, for example, cold workability is secured by subjecting the material to one of the following alternative annealing processes for softening: a low temperature annealing for stud bolts and the like, which require light cold working; a common annealing for hexagonal bolts and the like; and a spheroidizing annealing for flanged bolts and the like, which require heavy cold working.

However, the time-consuming softening process, especially the spheroidizing annealing, which takes as long as about 20 hours, constitutes an obstacle to the improvement of productivity. Besides, the cost of the annealing has come to account for a considerable portion in the total manufacturing costs of the machine components and the like because of the recent rise in energy costs.

In this situation, from the standpoints of the improvement of productivity and energy saving, various technologies have been proposed to shorten the time of the spheroidizing annealing applied prior to the cold forming.

Japanese Unexamined Patent Publication No. S56-41325, for example, discloses a method to produce a soft wire rod not requiring softening in secondary working, wherein a hot rolled steel wire rod is subjected to a rapid cooling and then a controlled cooling under a specific condition to form a homogeneous fine pearlite structure in order that the wire rod is softened to an effective level. But the Publication does not disclose any technologies to obtain a wire rod having the same level of softness to withstand heavy cold working as is obtainable by the spheroidizing annealing.

Japanese Unexamined Patent Publication No. S60-21327, as another example, discloses a method to roll a steel wire rod at a first-stage hot finishing mill, rapidly cool it, impose plastic strain at a second-stage finishing mill and then cool it without removing the strain in order to facilitate spheroidizing at a subsequent process. But, this method is meant to accelerate the spheroidizing by means of the plastic strain and not by means of controlling the metallographic structure.

SUMMARY OF THE INVENTION

In view of the above situation, the object of the present invention is to provide, through the control of metallographic structure, a steel wire rod or bar for machine structural use having, even with a short spheroidizing annealing time, as good a cold workability as the steel wire rods or bars softened by the conventional time-consuming spheroidizing annealing, and a method to produce the same.

The present inventors directed attention to the structure of steel wire rods or bars obtained through the spheroidizing annealing process and studied a method to secure cold workability by achieving the spheroidizing and softening through a short-time spheroidizing annealing and obtaining a structure equivalent to that obtained through the conventional spheroidizing annealing.

The present inventor discovered that the steel wire rods or bars produced by hot rolling a billet having a specific chemical composition at a low temperature and cooling under a controlled condition had a novel fine ferrite-pearlite structure as shown in FIG. 1, wherein cementite in the pearlite is partially granulated, and that the high-temperature retention time of the spheroidizing annealing could be shortened to about one half of the conventional retention time by obtaining the above metallographic structure; and established the present invention on the basis of the finding.

The gist of the present invention, therefore, is as follows:

(1) A hot rolled steel wire rod or bar for machine structural use, characterized in that: the wire rod or bar is made from a steel consisting of, by weight, 0.1 to 0.5% of C, 0.01 to 0.5% of Si, 0.3 to 1.5% of Mn, and the balance consisting of Fe and unavoidable impurities; its microstructure consists of ferrite and pearlite; its ferrite crystal grain size number defined under Japanese Industrial Standard (JIS) G 0552 is 11 or higher; the granular carbide 2 $\mu$m or less in circle-equivalent diameter and having an aspect ratio of 3 or less accounts for a percentage area of 3 to 15%; and its hardness (Hv) satisfies the expression below, $$165\ Ceq+73.5 \leqq Hv \leqq 195\ Ceq+73.5$$

(where, Ceq=C%+1/7 Si%+1/5 Mn%+1/9 Cr%).

(2) A hot rolled steel wire rod or bar for machine structural use according to the item (1), characterized by further containing, by weight, one or more of;

0.2 to 2.0% of Cr, 0.1 to 1.0% of Mo, 0.3 to 1.5% of Ni, 1.0% or less of Cu, and 0.005% or less of B.

(3) A hot rolled steel wire rod or bar for machine structural use according to the item (1) or (2), characterized by further containing, by weight, one or more of;

0.005 to 0.04% of Ti, 0.005 to 0.1% of Nb, and 0.03 to 0.3% of V.

(4) A method to produce a hot rolled steel wire rod or bar for machine structural use, characterized by subjecting a steel having the chemical composition specified in any one of the items (1) to (3) to a rough hot rolling in a temperature range from 850 to below 1,000° C., a finish hot rolling in a temperature range from the $Ar_3$ transformation temperature to 150° C. above it, a controlled cooling through a temperature range from 700 to 400° C. at a cooling rate of 5° C./sec. or higher and, immediately thereafter, a temperature retention in a furnace atmosphere controlled in a temperature range of 500 to 700° C. for 15 min. or longer but shorter than 1 h., so that the steel may have a ferrite crystal grain size number defined under JIS G 0552 of 11 or higher, contain the granular carbide 2 μm or less in circle-equivalent diameter and having an aspect ratio of 3 or less accounting for a percentage area of 3 to 15%, and have a hardness (Hv) satisfying the expression below, $$165\ Ceq+73.5 \leqq Hv \leqq 195\ Ceq+73.5$$

(where, Ceq=C%+1/7 Si%+1/5 Mn%+1/9 Cr%).

DESCRIPTION OF THE PREFERRED EMBODIMENTS

The present invention is described in detail hereafter.

Conventional hot rolled steel wire rods or bars have metallographic structure consisting of ferrite and lamellar pearlite and, therefore, their strength is high and it is difficult to process them by heavy cold working in an as hot rolled state. For this reason, in order to manufacture machine components having a prescribed strength, the wire rods or bars are softened by spheroidizing annealing before cold working, and a heat treatment for quenching and tempering is applied after the cold working.

The present invention makes it possible to reduce the time of the spheroidizing annealing to be applied before cold working by controlling the metallographic structure of hot rolled steel wire rods or bars.

The present inventors directed their attention to the metallographic structure of steel wire rods or bars before the spheroidizing annealing and found out that, for obtaining a soft steel material through a short-time spheroidizing annealing, it was necessary to soften the steel with ferrite-pearlite structure prior to the annealing and that it was preferable, for accelerating the spheroidizing, to evenly disperse carbon by making the ferrite-pearlite structure as fine as possible. Based on this finding, they discovered a novel metallographic structure of a steel wire rod or bar from which the same structure as is obtainable through conventional spheroidizing annealing could be obtained through a spheroidizing annealing with a high temperature retention time reduced to about one half of the conventional method.

The metallographic structure of the steel according to the present invention is described in the first place.

Figure 1:
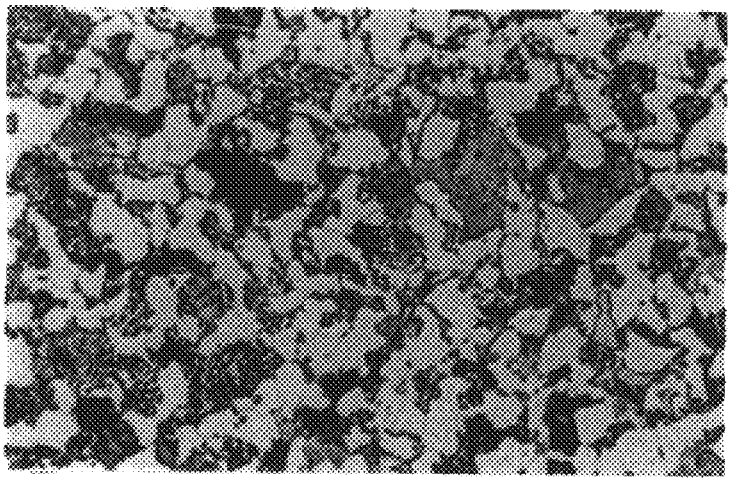
FIG. 1 is a micrograph (×1,000) of the metallographic structure of a hot rolled steel wire rod according to the present invention.

FIG. 1 is a micrograph (×1,000) of the metallographic structure of an as hot rolled steel wire rod or bar according to the present invention. As seen in the figure, the structure is a novel structure consisting of fine ferrite (α) and pearlite crystals and contains spheroidized granular carbide (cementite).

Figure 2:
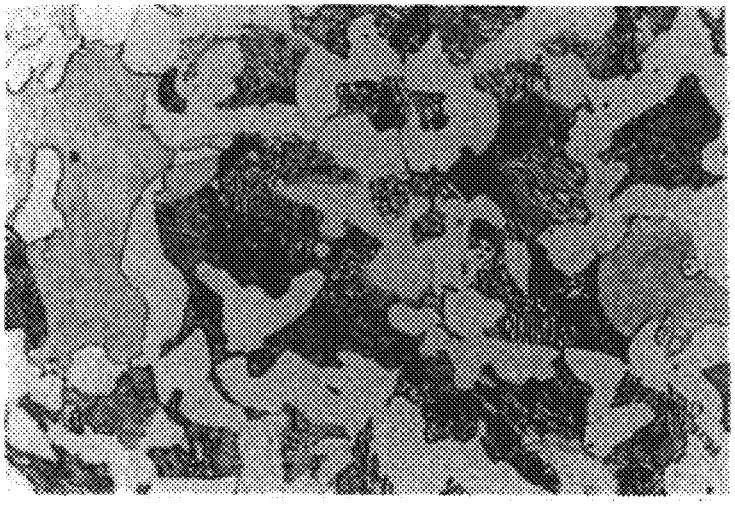
FIG. 2 is a micrograph (×1,000) of the metallographic structure of a conventional hot rolled steel wire rod.

FIG. 2 is a micrograph (×1,000) of the metallographic structure of an as hot rolled conventional steel wire rod. The structure of the as hot rolled conventional steel wire rod consists of large crystal grains of ferrite and lamellar pearlite.

Figure 3:
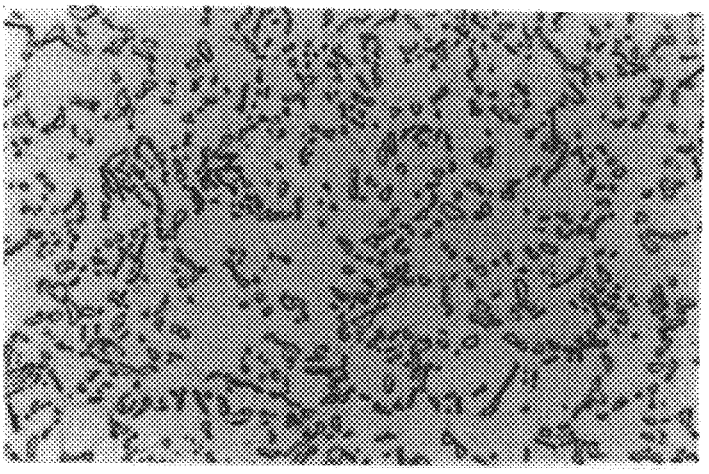
FIG. 3 is a micrograph (×1,000) of the metallographic structure of a hot rolled steel wire rod according to the present invention after a spheroidizing annealing.
Figure 4:
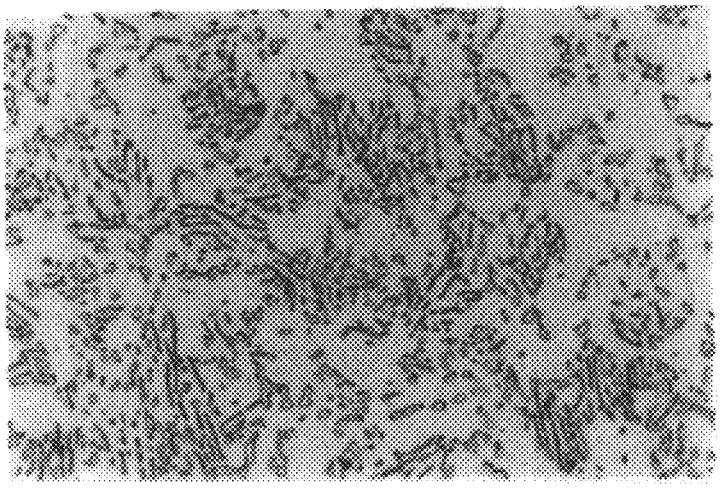
FIG. 4 is a micrograph (×1,000) of the metallographic structure of a conventional hot rolled steel wire rod after a spheroidizing annealing.

FIG. 3 is a micrograph (×1,000) of the material of FIG. 1 after a spheroidizing annealing, and FIG. 4 another (×1,000) of the material of FIG. 2 after the same.

As is clear from a comparison of FIGS. 1 and 2, the ferrite crystal grain size of the material according to the present invention is small, corresponding to a ferrite crystal grain size number defined under JIS G 0552 of 11 or higher.

Since the distance of carbon diffusion is decreased by making the crystal grain size number 11 or higher, solid solution of carbon is accelerated by the spheroidizing annealing, and this enables granules of spheroidized cementite, as shown in FIG. 3, to form in a short time. What is more, the ratio of granulation is higher than the conventional one by about 5% or more. The metallographic structure thus obtained contains the granules more homogeneously dispersed compared with that of the conventional material treated through the spheroidizing annealing shown in FIG. 4, and realizes excellent cold workability.

Besides, since the metallographic structure according to the present invention contains the granular carbide (cementite) as shown in FIG. 1, the granular carbide serves as nuclei and the granular cementite forms easily during the spheroidizing annealing. This means that, for making the spheroidizing annealing.time short, it is necessary to contain the granular carbide 2 μm or less in circle-equivalent diameter and having an aspect ratio of 3 or less in a percentage area of 3 to 15%.

Besides the above, by controlling the chemical composition and metallographic structure as defined in the present invention, the hardness (Hv) of the steel according to the present invention satisfies the expression below, $$165\ Ceq+73.5 \leqq Hv \leqq 195\ Ceq+73.5$$

(where, Ceq=C%+1/7 Si%+1/5 Mn%+1/9 Cr%).
Unless this expression is satisfied, it becomes difficult to reduce the spheroidizing annealing time.

As explained above, since the present invention accelerates the spheroidizing process during the spheroidizing annealing, a sufficient spheroidizing is achieved in a high temperature retention time about one half that of the conventional methods. Note that the portion of the annealing time excluding the high temperature retention time is the time for heating up the materials to a prescribed even temperature and cooling them therefrom.

Hereafter explained are the reasons why the chemical composition of the object steel is defined in the present invention.

C is indispensable for increasing steel strength to suit machine structural components and, with a C content less than 0.1%, the strength of final products is insufficient but, with a C content exceeding 0.5%, the toughness of the final products is deteriorated. The C content is, therefore, limited to 0.1 to 0.5%.

Si is added as a deoxidizing agent and to increase the strength of the final products through solid solution hardening. A Si content below 0.01% is insufficient for obtaining the above effects but, when it is added in excess of 0.5%, these effects are saturated and, adversely, toughness is lowered. The Si content is, therefore, limited to 0.01 to 0.5%. It has to be noted that, besides Si, Al can also be used for the deoxidation of steel. Use of Al, which is a strong deoxidizing agent, is preferable for attaining an especially low oxygen content. In such a case, 0.2% or less of Al may remain in the steel, but an Al content of this level is tolerable in the present invention.

Mn is effective for increasing the strength of the final products through the enhancement of hardenability but, with a Mn content below 0.3%, a sufficient effect is not obtained and, with an addition in excess of 1.5%, the effect is saturated and, adversely, toughness is lowered. The Mn content is, therefore, limited to 0.3 to 1.5%.

S is inevitably included in steel and exists there in the form of MnS. Since S contributes to the improvement of machinability and the formation of a fine crystal structure, its content of 0.1% or less is tolerable in the present invention. However, since S is detrimental to cold formability, it is preferable to limit its content to 0.035% or less when machinability is not required.

P is also inevitably included in steel, but it causes grain boundary segregation and center segregation, deteriorating toughness. It is, therefore, preferable to limit the P content to 0.035% or less.

While the fundamental chemical composition of the steel according to the present invention is as described above, the present invention further provides that one or more of Cr, Mo, Ni, Cu and B may be added as hardening elements. These elements are added to increase the strength of final products through the enhancement of hardenability and other effects. However, since the addition of these elements in large quantities increases hardness through the formation of bainite and martensite in the as hot rolled condition besides being uneconomical, their contents are limited as follows:

0.2 to 2.0% of Cr,
0.1 to 1.0% of Mo,
0.3 to 1.5% of Ni,
1.0% or less of Cu, and
0.005% or less of B.

Further, the present invention provides that one or more of Ti, Nb and V may be added for the purpose of grain size control. The effect is, however, insufficient when the content of Ti, Nb or V is below 0.005, 0.005 or 0.03%, respectively. On the other hand, when the content exceeds 0.04, 0.1 or 0.3%, respectively, the effect is saturated and toughness is deteriorated. The contents of these elements are, therefore, limited as follows:

0.005 to 0.04% of Ti,
0.005 to 0.1% of Nb, and
0.03 to 0.3% of V.

The method to produce a steel wire rod or bar for machine structural use according to the present invention is described hereafter.

Figure 5:
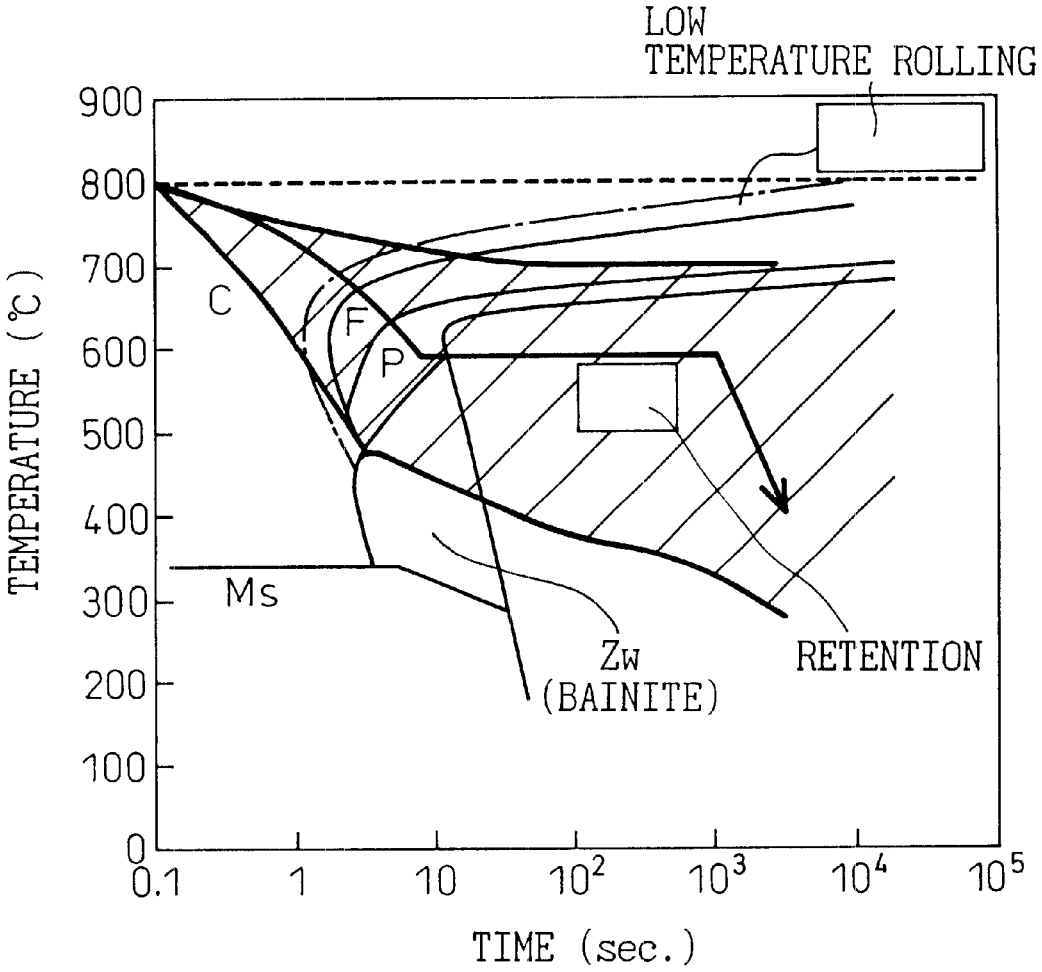
FIG. 5 is a diagram showing CCT curves for explaining the cooling condition according to the present invention.

FIG. 5 is a diagram of CCT curves for explaining the cooling condition in the production process according to the present invention.

By the present invention, a steel wire rod or bar having a novel metallographic structure is produced through the finish rolling of billets of a steel according to any one of claims 1 to 3 at a low temperature to form fine austenite grains, and then inducing ferritic and pearlitic transformations as shown in FIG. 5 by controlling a cooling rate. The steel wire rod or bar thus obtained can be processed in a short spheroidizing annealing time into a steel wire rod or bar for machine structural use excellent in cold workability.

According to the present invention, in the first place, a steel billet is rough hot rolled in a temperature range from 850 to below 1,000° C. and finish hot rolled in a temperature range immediately above the $Ar_3$ transformation temperature, that is from $Ar_3$ to 200° C. above it. Then, subsequent to the low temperature rolling, the rolled steel material is subjected to a controlled cooling from 700° C. at the lowest to 400° C. at a cooling rate of 5° C./sec. or more and, immediately after that, held in a furnace atmosphere kept in a temperature range of 500 to 700° C. for 15 min. or more but less than 1 h.

The reason why the rough hot rolling temperature is defined as from 850 to below 1,000° C. is that, at a temperature below 850° C., austenite grains are not made sufficiently fine but, at 1,000° C. or above, the austenite grains become coarse. The austenite grains are made fine by applying the finish hot rolling at a temperature immediately above $Ar_3$ and their grain boundaries serve as the sites for ferrite nucleation, and, thus, the ferritic transformation is accelerated, the ferrite percentage increases, and the ferrite crystal grain size number defined in JIS G 0552 becomes 11. Although it is preferable to conduct the finish hot rolling at a temperature immediately above $Ar_3$, it is practically difficult to maintain the temperature at immediately above $Ar_3$. For this reason, the present invention sets a tolerable upper limit at 200° C. above $Ar_3$. Note that, when the finish hot rolling temperature is below $Ar_3$, the rolling is conducted at the two-phase zone of austenite and ferrite. In such a case, a homogeneous and fine ferrite-pearlite structure is not obtained after the rolling and an unwelcome acicular ferrite-bainite structure may form locally.

As is shown with the CCT curves in FIG. 5, the low temperature rolling according to the present invention causes the ferritic transformation to take place immediately and the beginning of the ferritic transformation to shift to the shorter time side as shown with the chain lines. As a result, the ferrite percentage increases. It follows that the pearlitic transformation also shifts to the shorter time side, that the transformation temperature goes up and that C diffusion is accelerated. All this results in the granulation of cementite and the broadening of pearlite lamella space.

Unless the cooling is commenced from 700° C. at the lowest, sufficiently fine ferrite and pearlite grains are not obtained, and unless the slow cooling end temperature is 400° C. or higher, preferably 450° C. or higher, on the other hand, fine ferrite and pearlite grains are not obtained. The slow cooling temperature range is, therefore, defined as from 700 to 400° C.

If the cooling rate is below 5° C./sec., any of the granulation of cementite, the broadening of the pearlite lamella space and the increase in the ferrite percentage is not achieved and, moreover, fine grains of the ferrite and pearlite cannot be obtained.

For the reasons described above, the present invention stipulates that the cooling has to be conducted through the temperature range from 700 to 400° C. at a cooling rate of 5° C./sec. or higher. Hot water, air blast or some other means may be used for the cooling. The granulation of cementite and the softening of a steel are both achieved by holding a wire rod or bar in a furnace atmosphere kept in a temperature range of 500 to 700° C. for 15 min. or more but less than 1 h. immediately after the controlled cooling.

As a result of the above, the steel can contain the granular carbide (cementite) 2 $\mu$m or less in circle-equivalent diameter and having an aspect ratio of 3 or less in a percentage area of 3 to 15%.

EXAMPLE 1

The present invention is explained more specifically hereafter based on examples.

Table 1 shows chemical compositions of specimens. All the specimens were produced by continuous casting after refined in a converter, then cast blooms were broken down into billets 162 mm×162 mm in section and then the billets were rolled into wire rods 11 mm in diameter under the conditions listed in Table 2. The specimens of rolling No. I according to the present invention were rough hot rolled at 900° C. and finish hot rolled at 750° C., well within the temperature range between $Ar_3$ and 150° C. above it, then underwent a cooling with hot water or air blast (applied to high hardenability materials, details are given in Table 2), finished the accelerated cooling at a steel temperature of 400° C. or higher and 650° C. or lower, and immediately after that, were held in a slow cooling furnace atmosphere kept at 600° C. for 30 min. After that, the specimens were annealed for spheroidizing for a short time. In this spheroidizing annealing, the high temperature retention time was reduced to half and the furnace resident time was set at 13.5 h., compared with the normal spheroidizing annealing under the condition of a high retention temperature of 740° C. and a resident time of 17 h. as mentioned below. The materials of rolling No. II, which are comparative specimens, were rough hot rolled at 1,050° C. and finish hot rolled at 900° C., and then underwent a controlled cooling on a coil transfer line covered with a slow cooling cover. After that, the comparative specimens of rolling No. II were subjected to a normal spheroidizing annealing under the condition of a high retention temperature of 740° C. and a resident time of 17 h.

The tensile strength, microstructure, ferrite crystal grain size number and percentage area of the granular carbide of the invented and comparative specimens are compared in Table 3 as the indicators of the acceleration of spheroidizing of the as rolled specimens. Besides the above, tensile strength, spheroidizing ratio and reduction of area are evaluated as the indicators of the degree of spheroidizing. The results of the invented and comparative specimens are compared also in Table 3.

As is clear in the table, whereas the ferrite grain size reduction and the granular carbide are seldom seen in the as rolled comparative specimens of rolling No. II, the specimens according to the present invention contain great quantities of fine ferrite grains having a ferrite crystal grain size number of 11 as well as granular carbide. Thanks to this, the specimens according to the present invention show a spheroidized structure and a level of softening equal to or better than those obtainable by conventional methods, despite the fact that the high temperature retention time in the spheroidizing annealing is reduced to one half of the conventional one.

TABLE 1

(wt %)

| Steel No. | C | Si | Mn | P | S | Cr | Mo | Al | Ni | Cu | B | Ti | Nb | V |
|---|---|---|---|---|---|---|---|---|---|---|---|---|---|---|
| A | 0.44 | 0.23 | 0.78 | 0.014 | 0.025 | 0.05 | — | 0.023 | — | — | — | — | — | — |
| B | 0.40 | 0.24 | 0.68 | 0.011 | 0.010 | — | — | 0.025 | — | — | — | — | — | — |
| C | 0.35 | 0.25 | 0.70 | 0.013 | 0.008 | — | — | 0.025 | — | — | — | — | — | — |
| D | 0.25 | 0.23 | 0.71 | 0.012 | 0.010 | — | — | 0.024 | — | — | — | — | — | — |
| E | 0.40 | 0.25 | 0.77 | 0.020 | 0.020 | 1.02 | — | 0.032 | — | — | — | — | — | — |
| F | 0.35 | 0.19 | 0.80 | 0.015 | 0.022 | 1.00 | 0.18 | 0.033 | — | — | — | — | — | — |
| G | 0.15 | 0.20 | 0.55 | 0.013 | 0.022 | 0.55 | 0.17 | 0.029 | 0.55 | — | — | — | — | — |
| H | 0.25 | 0.26 | 0.35 | 0.010 | 0.009 | — | — | 0.030 | — | — | 0.0018 | 0.02 | — | — |
| I | 0.45 | 0.04 | 0.35 | 0.014 | 0.006 | — | — | 0.020 | — | — | 0.0020 | 0.02 | — | — |
| J | 0.25 | 0.20 | 0.35 | 0.008 | 0.008 | — | — | 0.035 | — | 0.20 | 0.0016 | 0.04 | — | — |
| K | 0.24 | 0.23 | 0.34 | 0.010 | 0.015 | — | — | 0.030 | — | — | 0.0020 | 0.02 | 0.05 | — |
| L | 0.25 | 0.25 | 0.37 | 0.011 | 0.014 | — | — | 0.025 | — | — | 0.0025 | 0.02 | — | 0.10 |

TABLE 2

| Classification | Rolling No. | Rolled diameter (mm) | Rough rolling temperature (° C.) | Finish rolling temperature (° C.) | Means of cooling from 700 to 400° C. after rolling | Slow cooling |
|---|---|---|---|---|---|---|
| Inventive specimen | I | 11 | 900 | 750 | Hot water, air blast | Furnace atmosphere at |

TABLE 2-continued

| Classification | Rolling No. | Rolled diameter (mm) | Rough rolling temperature (° C.) | Finish rolling temperature (° C.) | Means of cooling from 700 to 400° C. after rolling | Slow cooling |
|---|---|---|---|---|---|---|
| | | | | | | 600° C. × 30 min. |
| Comparative specimen | II | 11 | 1050 | 900 | Slow cooling cover | Not applied |

TABLE 3

| | | | | As rolled material | | | | Spheroidizing-annealed material | | |
|---|---|---|---|---|---|---|---|---|---|---|
| Classification | Symbol | Steel No. | Rolling No. | Microstructure | Ferrite grain size number | Tensile strength (MPa) | Percentage area of granular carbide | Tensile strength (MPa) | Spheroidizing ratio (%) | Reduction of area (%) |
| Inventive specimen | 1 | A | I | F + P + S | 12.5 | 611 | 9 | 495 | 95 | 67 |
| Comparative specimen | 2 | " | II | F + P | 8.5 | 704 | — | 497 | 90 | 65 |
| Inventive specimen | 3 | B | I | F + P + S | 12.3 | 585 | 7 | 470 | 95 | 65 |
| Comparative specimen | 4 | " | II | F + P | 8.5 | 653 | — | 474 | 90 | 64 |
| Inventive specimen | 5 | C | I | F + P + S | 12.0 | 540 | 7 | 452 | 95 | 70 |
| Comparative specimen | 6 | " | II | F + P | 8.3 | 591 | — | 457 | 90 | 65 |
| Inventive specimen | 7 | D | I-1 | F + P + S | 12.1 | 474 | 6 | 424 | 95 | 68 |
| Comparative specimen | 8 | " | II | F + P | 9.1 | 511 | — | 428 | 90 | 66 |
| Inventive specimen | 9 | E | I-2 | F + P + S | 12.3 | 717 | 8 | 545 | 95 | 65 |
| Comparative specimen | 10 | " | II | F + P | 9.0 | 748 | — | 547 | 90 | 62 |
| Inventive specimen | 11 | F | I-2 | F + P + S | 12.1 | 652 | 5 | 555 | 95 | 69 |
| Comparative specimen | 12 | " | II | F + P | 8.9 | 734 | — | 564 | 90 | 63 |
| Inventive specimen | 13 | G | I-2 | F + P + S | 12.4 | 596 | 7 | 559 | 95 | 67 |
| Comparative specimen | 14 | " | II | F + P | 9.1 | 748 | — | 568 | 90 | 65 |
| Inventive specimen | 15 | H | I-2 | F + P + S | 11.9 | 560 | 6 | 454 | 95 | 67 |
| Comparative specimen | 16 | " | II | F + P | 8.8 | 646 | — | 459 | 90 | 63 |
| Inventive specimen | 17 | I | I-2 | F + P + S | 11.5 | 484 | 9 | 453 | 95 | 69 |
| Comparative specimen | 18 | " | II | F + P | 9.0 | 571 | — | 459 | 90 | 64 |
| Inventive specimen | 19 | J | I-2 | F + P + S | 11.7 | 562 | 8 | 465 | 95 | 70 |
| Comparative specimen | 20 | " | II | F + P | 9.1 | 662 | — | 469 | 90 | 65 |
| Inventive specimen | 21 | K | I-2 | F + P + S | 12.8 | 560 | 8 | 471 | 90 | 65 |
| Comparative specimen | 22 | " | II | F + P | 9.1 | 662 | — | 477 | 80 | 63 |
| Inventive specimen | 23 | L | I-2 | F + P + S | 12.7 | 515 | 8 | 523 | 90 | 63 |
| Comparative specimen | 24 | " | II | F + P | 9.2 | 713 | — | 527 | 80 | 60 |

F: ferrite;
P: pearlite;
S: granular carbide

As explained hereinbefore, a hot rolled steel wire rod or bar for machine structural use according to the present invention allows the high temperature retention time of a spheroidizing annealing before cold working to be reduced to about one half that of conventional practice, and the degree of softening thus obtained is equal to or better than that of a steel wire rod or bar treated through the conventional spheroidizing annealing. The present invention, therefore, has the effects to enhance productivity and to save energy as a result of the reduced spheroidizing annealing time.

What is claimed is:

1. A hot rolled steel wire rod or bar for machine structural use, characterized in that: the wire rod or bar is made from a steel consisting of, in weight, 0.1 to 0.5% of C, 0.01 to 0.5% of Si, 0.3 to 1.5% of Mn, and the balance consisting of Fe and unavoidable impurities; its microstructure consists of ferrite and pearlite; its ferrite crystal grain size number defined under Japanese Industrial Standard (JIS) G 0552 is 11 or higher; the granular carbide 2 $\mu$m or less in circle-equivalent diameter and having an aspect ratio of 3 or less accounts for a percentage area of 3 to 15%; and its hardness (Hv) satisfies the expression below, $$165\ Ceq+73.5 \leqq Hv \leqq 195\ Ceq+73.5$$

(where, Ceq=C%+1/7 Si%+1/5 Mn%+1/9 Cr%).

2. A hot rolled steel wire rod or bar for machine structural use according to claim 1, characterized by further containing, in weight, one or more of;

0.2 to 2.0% of Cr, 0.1 to 1.0% of Mo, 0.3 to 1.5% of Ni, 1.0% or less of Cu, and 0.005% or less of B.

3. A hot rolled steel wire rod or bar for machine structural use according to claim 1 or 2, characterized by further containing, in weight, one or more of;

0.005 to 0.04% of Ti, 0.005 to 0.1% of Nb, and 0.03 to 0.3% of V.

4. A method to produce a hot rolled steel wire rod or bar for machine structural use, characterized by subjecting a steel having the chemical composition specified in claim 1 or 2 to a rough hot rolling in a temperature range from 850 to below 1,000° C., a finish hot rolling in a temperature range from the $Ar_3$ transformation temperature to 150° C.

above it, a controlled cooling through a temperature range from 700 to 400° C. at a cooling rate of 5° C./sec. or higher and, immediately thereafter, a temperature retention in a furnace atmosphere controlled in a temperature range of 500 to 700° C. for 15 min. or longer but shorter than 1 h., so that the steel may have a ferrite crystal grain size number defined under JIS G 0552 being 11 or higher, contain the granular carbide 2 μm or less in circle-equivalent diameter and having an aspect ratio of 3 or less accounting for a percentage area of 3 to 15%, and have a hardness (Hv) satisfying the expression below, $$165\ Ceq+73.5 \leqq Hv \leqq 195\ Ceq+73.5$$

(where, Ceq=C%+1/7 Si%+1/5 Mn%+1/9 Cr%).

5. A method to produce a hot rolled steel wire rod or bar for machine structural use, characterized by subjecting a steel having the chemical composition specified in claim 3 to a rough hot rolling in a temperature range from 850 to below 1,000° C., a finish hot rolling in a temperature range from the $Ar_3$ transformation temperature to 150° C. above it, a controlled cooling through a temperature range from 700 to 400° C. at a cooling rate of 5° C./sec. or higher and, immediately thereafter, a temperature retention in a furnace atmosphere controlled in a temperature range of 500 to 700° C. for 15 min. or longer but shorter than 1 h., so that the steel may have a ferrite crystal grain size number defined under JIS G 0552 being 11 or higher, contain the granular carbide 2 μm or less in circle-equivalent diameter and having an aspect ratio of 3 or less accounting for a percentage area of 3 to 15%, and have a hardness (Hv) satisfying the expression below, $$165\ Ceq+73.5 \leqq Hv \leqq 195\ Ceq+73.5$$

(where, Ceq=C%+1/7 Si%+1/5 Mn%+1/9 Cr%).

* * * * *